US006925718B2

(12) United States Patent
Bartmann et al.

(10) Patent No.: US 6,925,718 B2
(45) Date of Patent: Aug. 9, 2005

(54) TOOL HEAD

(75) Inventors: Udo Bartmann, Schwäbisch Gmünd (DE); Roland Schierling, Affalterbach (DE); Reinhard Friedrich, Waiblingen (DE)

(73) Assignee: Andreas Stihl AG & Co. (DE)

( * ) Notice: Subject to any disclaimer, the term of this patent is extended or adjusted under 35 U.S.C. 154(b) by 74 days.

(21) Appl. No.: 10/219,377

(22) Filed: Aug. 12, 2002

(65) Prior Publication Data

US 2002/0194737 A1 Dec. 26, 2002

Related U.S. Application Data

(63) Continuation-in-part of application No. 09/668,434, filed on Sep. 22, 2000, now abandoned.

(30) Foreign Application Priority Data

Sep. 22, 1999 (DE) ..... 299 16 643 U

(51) Int. Cl.[7] ..... A01D 34/00; A01D 34/412

(52) U.S. Cl. ..... 30/276; 30/347; 56/295; 83/665

(58) Field of Search ..... 30/276, 347; 56/17.5, 56/295; 83/665, 666

(56) References Cited

U.S. PATENT DOCUMENTS 3,564,824 A * 2/1971 Tygh ..... 56/295
6,230,600 B1 * 5/2001 Stroud ..... 83/665
6,243,956 B1 * 6/2001 Nilsson et al. ..... 30/389

* cited by examiner

*Primary Examiner*—Douglas D Watts
(74) *Attorney, Agent, or Firm*—Robert W Becker & Associates; Robert W Becker

(57) ABSTRACT

A tool head for a motor-driven, manually guided implement for receiving a rotatable cutter tool is provided. The tool head comprises a housing in which is provided a tool shaft that is rotatably mounted via bearings. Secured on the tool shaft so as to turn with it is a tool carrying mechanism for the cutter tool. This tool carrying mechanism includes an engagement plate having an engagement surface, which is oriented perpendicular to the axis of the shaft, and a centering shoulder. The engagement plate and a centering element having the centering shoulder are embodied as separate components. The engagement plate is of light weight construction and is positively connected with the tool shaft. The centering element is made of a material, the hardness of which is adapted to the cutter tool.

12 Claims, 5 Drawing Sheets

TOOL HEAD

CROSS-REFERENCE TO RELATED APPLICATIONS

This application is a continuation-in-part of application Ser. No. 09/668,434 filed Sep. 22, 2000, now abandoned.

BACKGROUND OF THE INVENTION

The present invention relates to a motor-driven, manually guided implement for receiving a rotatable cutter tool.

Tool heads, especially for rapidly rotating cutter tools, such as with brush cutters, edgers, cut-off saws, etc., are constructed pursuant to light weight standards taking into consideration handling ability, low centrifugal forces, and the avoidance of vibration problems. With such tool heads, rapidly rotating tools such as blades or filament reels, in order to avoid imbalances, are oriented at right angles and centrally relative to the longitudinal axis of the tool shaft by means of a tool carrying mechanism. For this purpose, the tool carrying mechanism is provided with an engagement plate having a contact surface that is oriented perpendicular to the shaft axis and against which rests the cutter tool, which is thereby held perpendicular to the shaft axis. In addition, a centering shoulder is provided for the central orientation of the cutter tool relative to the axis of rotation. Due to the typically relatively large diameter of the engagement plate and of the centering shoulder relative to the diameter of the tool shaft, and due to the dynamic forces that thereby result at high speeds, a light weight construction for these components is particularly important.

Also to be taken into consideration is that especially with rapidly rotating blades, which accidentally come into contact with hard objects such as rocks or branches, high radial forces can occur between the cutter tool and the centering shoulder. These forces then lead to increased and undesired wear of the centering shoulder, of the cutter tool in the region of the centering shoulder, or even both components.

DE 195 42 144 A1 shows a known tool head, on the tool shaft of which is disposed a tool hub that is positively connected with the shaft and is embodied as a protection against twisting. Integrally embodied with the tool hub are a centering shoulder and a flange having a contact surface against which is aligned a cutter tool having a safety plate disposed between the cutter tool and the contact surface. This known tool hub is a massive, relatively large component having a high weight when embodied as a steel component. If the hub is made of aluminum, wear problems can occur at the centering shoulder, as a consequence of which the entire component must be replaced.

It is therefore an object of the present invention to provide a light weight tool head having a tool carrying mechanism that is resistant to wear.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
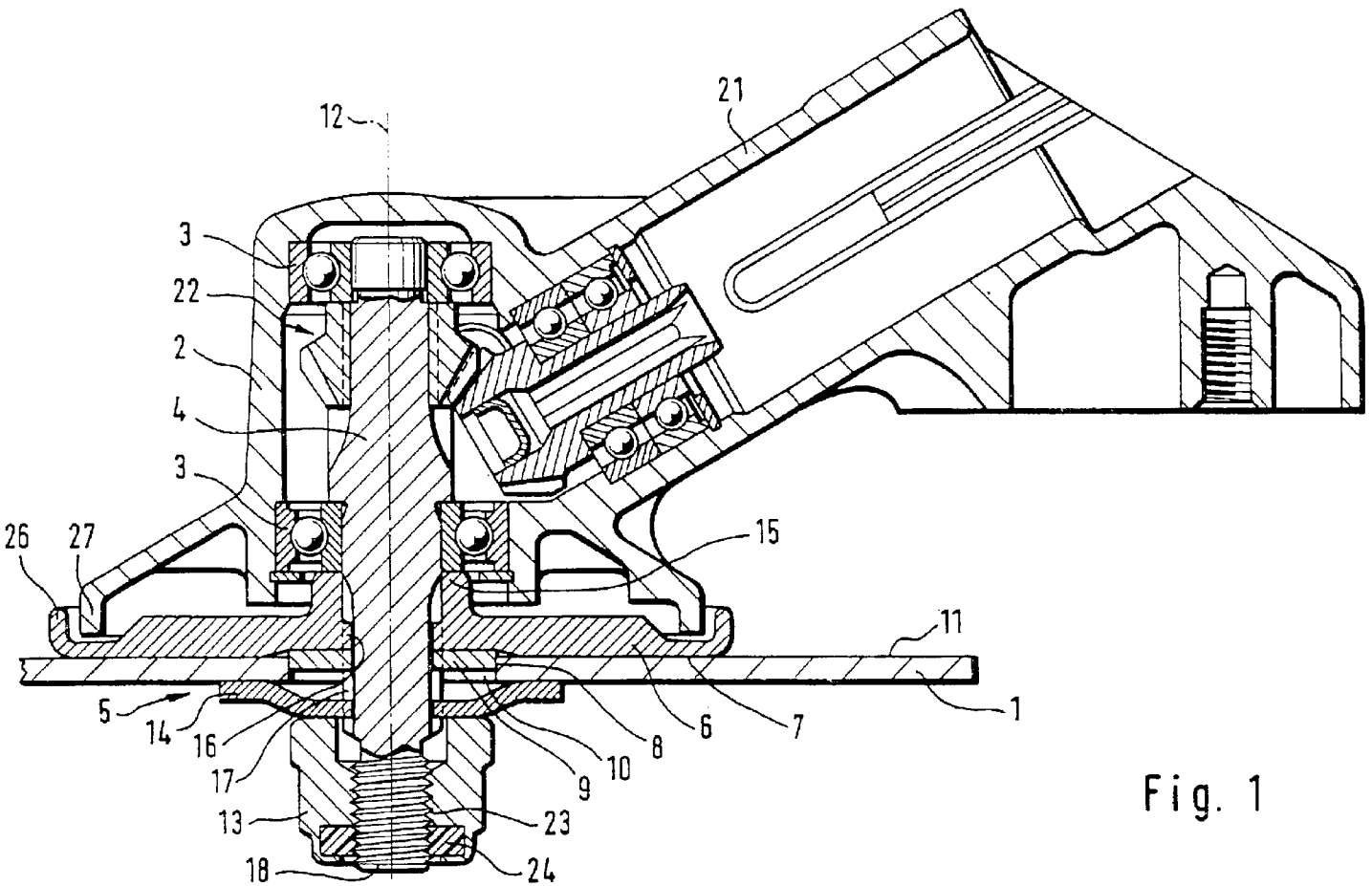
FIG. 1 is a cross-sectional view of one exemplary embodiment of an inventive tool head.

The tool head of the present invention comprises a tool shaft that is rotatably mounted in a housing via bearing means, and a tool carrying mechanism that includes a light weight engagement plate that is positively connected with the tool shaft and has a contact surface that is oriented at least substantially perpendicular to the axis of the tool shaft, wherein the tool carrying mechanism further includes a separate component as a centering element that forms a centering shoulder for a cutter tool, wherein the centering element is made of a material having a hardness that is adapted to the material of the cutter tool.

The basic concept of the present invention is that the centering as well as the drive and the angular orientation of the cutter tool is realized by two functionally separated components. As a result, the two components can be adapted in construction and selection of material to the stresses that occur, thereby enabling at the same time resistance to wear and optimization of weight.

The purpose of the engagement plate of the inventive tool head, in addition to covering the head housing that is open toward the cutter tool, is to transmit torque from the tool shaft to the cutter tool, and the right angled orientation of the cutter tool relative to the shaft axis. For this purpose, the engagement plate is positively connected with the tool shaft. The operational loads that thereby occur act essentially in the circumferential direction and perpendicular to the plane of the plate, and have a relatively low magnitude. The engagement plate therefore has a light weight construction and is preferably an aluminum forged part. This leads to low centrifugal forces and to the avoidance of vibrations in the drive train. In addition to being embodied as a forged part, an economical manufacture has a cast or sintered part is also possible.

Functionally separate from the engagement plate is a centering element that is a separate component, has a centering shoulder, and in particular is embodied as a flat disk against which the cutter tool is radially centered relative to the axis of rotation. Furthermore, its function is the absorption of radial forces. Depending upon the type of cutter selected, and the operating loads that result therefrom and act in the radial direction, the centering element, in order to avoid wear, is adapted in its hardness to the material of the cutter tool, and preferably has approximately the same hardness as does the cutter tool in the region of the centering element. This prevents the stresses of the insides of the holes that occur between the cutter tool and the centering element from excessively stressing either of the components and causing premature wear. Especially if the cutter blade is made of steel the centering element is also made of steel, thus ensuring low wear of both components in the region of the centering. Due to the small size of the centering element, even if a hard and heavy material is selected for such element, the overall increase in weight of the tool carrying mechanism is low.

The centering element is preferably elastically resilient such that due to its radial spring force it is frictionally fixed in position in the axial direction on the tool shaft. On the one hand, this ensures that the centering element cannot accidentally drop off of the tool shaft as the cutter tool is exchanged, and on the other hand it is easy to install or remove the centering element.

Pursuant to one modification, the centering element is embodied as a wavy retaining ring and is axially held in a circumferential groove of the tool shaft. The positive connection thus established prevents the centering element from sliding axially.

In another embodiment of the present invention, the centering shoulder is formed on a disk body, which serves as the centering element. The disk body comprises hardened steel, having a selected range of hardness.

Pursuant to a further embodiment of the present invention, the centering element also fulfills the objective of providing protection against losing the engagement plate. For this purpose, in the axial direction the engagement plate is placed upon the tool shaft in a manner free of seizing, and is held by the centering element in the direction of the free end of the tool shaft. This permits a simple assembly or removal of the engagement plate by placement upon or removal essentially without a tool. Furthermore, during exchange of the cutter tool, in addition to the centering element also the engagement plate cannot accidentally drop from the tool shaft.

The transmission of torque between the tool shaft and the engagement plate is preferably effected by means of an inner toothing in the hub of the engagement plate, with such toothing engaging an external toothing of the tool shaft. This enables a reliable transmission of torque with a good ability to run true, and due to the axial displaceability provided when the centering element is removed, enables a simple assembly or removal.

The centering element is preferably embodied as a circular disk having a central opening that is concentric to the outer periphery and through which the tool shaft can be inserted. The circular disk has a slot-like cut through, as a consequence of which it becomes a spring ring that is elastic in the circumferential direction. Provided in the central opening is a toothing that preferably comprises three teeth that together have an angular offset relative to the external toothing on the tool shaft. Due to this angular offset on the one hand, and the embodiment of the circular disk as a spring ring on the other hand, in the installed state the centering element is held by elastic spring force and can be installed or removed by a simple tool, such as a spring ring plyers. The toothing, by means of tooth side centering, enables a high run true precision.

Further specific features of the present invention will be described in detail subsequently.

DESCRIPTION OF PREFERRED EMBODIMENTS

Figure 2:
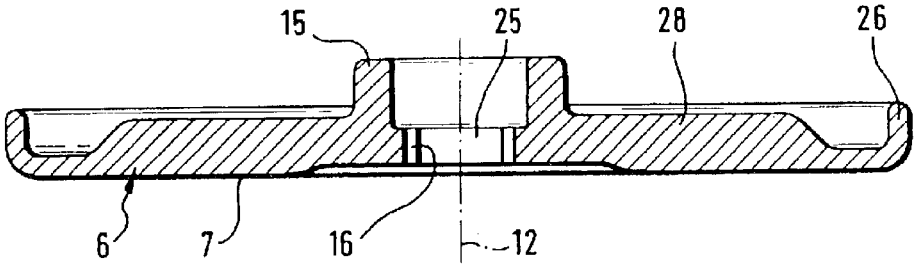
FIG. 2 shows a detailed view of the engagement plate.

Referring now to the drawings in detail, FIG. 1 shows a tool head having mounted thereon a cutter tool 1, which in the illustrated embodiment is a steel cutting blade, but which could also be a filament reel, a circular saw blade, etc. The cutter tool 1 is driven by a tool shaft 4 that is rotatably mounted in two bearing means 3 in a head housing 2. The housing 2 has a shank 21 that is disposed at an angle to the shaft axis 12 and through which is guided a non-illustrated, motor-driven drive shaft. In the illustrated embodiment, the housing 2 and the shank 21 are monolithic. Disposed in the region of the connection location between the head housing 2 and the shank 21 is a bevel gear arrangement 22 for driving the tool shaft 4. Disposed in the region of the free end 18 of the tool shaft 4 is a thread 23, with an external toothing 17 being provided between the thread 23 and the bearing means 3. An engagement plate 6 and a centering element 9 are placed upon the tool shaft 4 in the region of the external toothing 17. As can be seen from FIG. 2, the engagement plate 6 is provided in the middle with a hub 15 having an internal toothing 16, by means of which the engagement plate 6 is connected with the tool shaft 4 in a positive manner, and in the axial direction in a manner free of seizing. The connection of the engagement plate 6 with the tool shaft 4 can also be effected by means of a tapered connection, a grooved toothing, an adjusting key connection, a multi-sided or polygonal profile, a frictional connection, etc. The engagement plate 6 has a lightweight construction, and in the illustrated embodiment is an aluminum forged part. As viewed in the radial direction, in the vicinity of the hub 15, the engagement plate 6 is provided with a thicker portion 28 to provide reenforcement against stresses acting in a direction perpendicular to the plane of the plate.

Instead of the thicker portion 28, it would also be possible to provide reinforcing ribs or the like. The engagement plate could also be a stamped sheet metal component, or could be produced by extrusion molding, die casting, machining or sintering metallic material, or could be made of sintered or injection molded plastic. In addition to aluminum, other metals that could be used include magnesium, zinc, titanium, or steel. If made of polymeric material, the engagement plate could also be reenforced with glass or carbon fibers. It would also be possible to make the engagement plate 6 as a ceramic component.

In the peripheral region, the engagement plate 6 is provided with a collar 26, which as shown in FIG. 1 surrounds the housing rim 27 of the housing 2, so that the housing 2, which is open in the direction of the cutter tool 1, is covered by the engagement plate 6 and is protected from dirt that is churned up.

The engagement plate 6 has a contact surface 7 that is oriented at least substantially perpendicular to the shaft axis 12. The side 11 of the cutter tool 1 rests substantially flush against the contact surface 7, and in this manner is oriented substantially perpendicular to the shaft axis 12. The cutter tool 1 is pressed against the contact surface 7 by means of a nut 13 and a cup spring 14 that is interposed between the cutter tool 1 and the nut 13, which is threaded onto the thread 23 and is embodied as a stop nut by means of a plastic ring 24; as a result, the cutter tool 1 is frictionally connected with the engagement plate 6 in such a way as to transmit torque.

Figure 3:
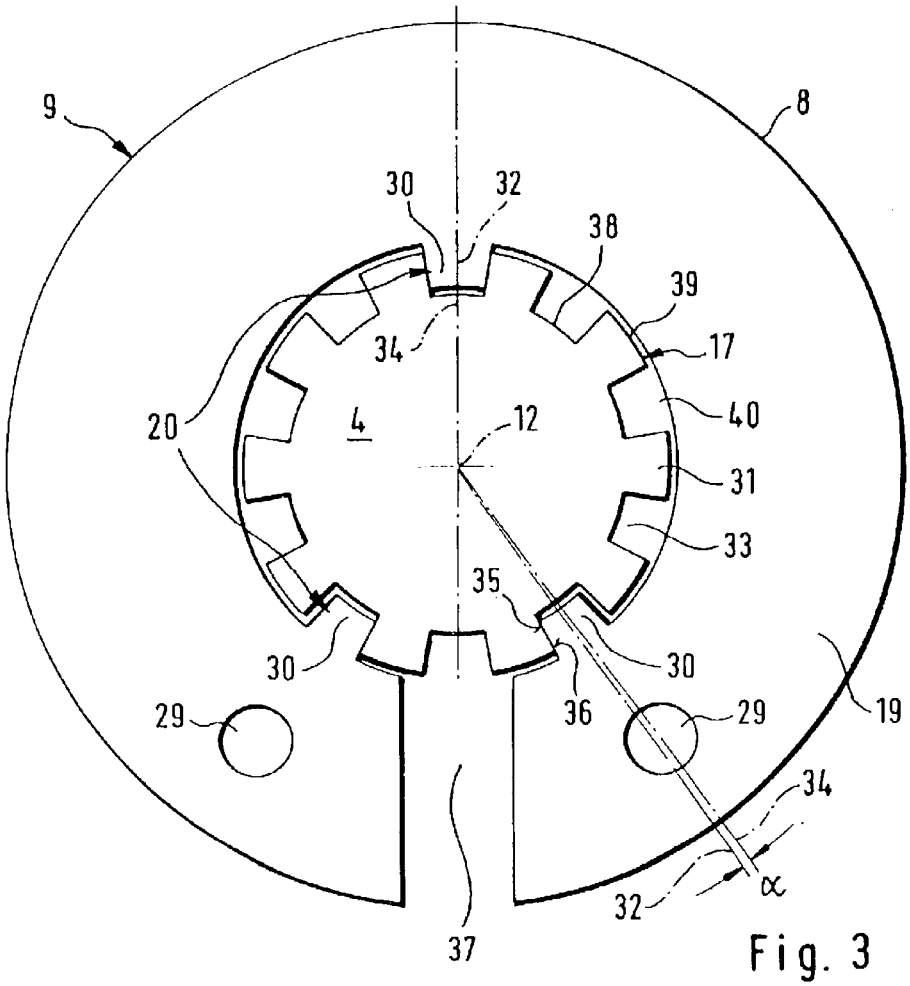
FIG. 3 shows the centering element of FIG. 1 placed upon the tool shaft, which is illustrated in cross-section.

Centering of the cutter tool 1 relative to the shaft axis 12 is effected via the centering element 9. The centering element can be a sleeve or the like, and in the illustrated embodiment is a flat, circular disk 19 having a circular centering shoulder 8 (FIG. 3). As shown in FIG. 1, the cutter tool 1 is provided in the middle with a circular opening 10 in which the circular centering shoulder 8 is seated in a manner free of play, thus ensuring a centering of the cutter tool 1 relative to the shaft axis 12. The engagement plate 6, the centering element 9, and the cup spring 14 form the tool carrying mechanism 5. The centering element 9 is a separate component, and is made of a material having a hardness that is adapted to or compatible with the material of the cutter tool 1. In the illustrated embodiment, not only the cutter tool 1 but also the centering element 9 are made of steel having approximately the same hardness, whereby the centering element 9 can also be made of heat-tempered steel, sintered steel, or case hardened steel. In addition, ceramic can also be an advantageous material.

In the illustrated embodiment, the centering element 9 is elastically resilient, and due to its radial spring force is frictionally fixed in position in the axial direction on the tool shaft 4 in the vicinity of the external toothing 17. The engagement plate 6, which is placed upon the tool shaft 4 so as to be free of seizing in the axial direction, is held in the direction of the free end 18 of the tool shaft 4 by the centering element 9, and in the opposite direction is held by a bearing means 3.

FIG. 3 illustrates the details of the centering element 9, which is embodied as a circular disk 19, and in particular shows the connection of the centering element 9 with the tool shaft 4. The circular centering element 9 is made of an elastically resilient material, in particular steel, and has a slot 37, as a result of which it becomes a spring ring that is elastic in the circumferential direction. Provided in the middle is an opening 40 that is connected to the outer contour by the slot 37. The opening 40 has an internal toothing 20 that engages in the spaces 33 between the external teeth 17 of the tooth shaft 4. In the illustrated embodiment, the internal toothing 20 comprises three teeth 30, one of which is disposed across from the slot 37, with the other two being disposed on both sides of the slot 37. The axis 32 of the disk teeth 30 is offset by the angle a relative to the axis 34 of the spaces 33 between the teeth 17. Due to the elastic properties in the circumferential direction of the centering element 9, and due to the angular offset a, the sides 35 of the external toothing 17, and the sides 36 of the disk teeth 30, come into contact under pressure, as a result of which the centering element 9 is held in a wedged manner. Provided on both sides of the slot 37 is a respective tool hole 29 that can be engaged by a tool, such as a spring ring plyers, for spreading and hence releasing the centering element 9. So that despite the angular offset $\alpha$ the centering element 9 can be installed or removed, the angular offset is preferably of such a small dimension that the deformation of the centering element 9 during the installation or removal process remains in the elastic range. In the illustrated embodiment, the angular offset a is approximately 1°.

The centering element 9 is centered at the sides 35 and 36 relative to the shaft axis 12, but could also be centered at the tooth base 38 or at the tooth tips 39. The circular centering shoulder 8 can also be embodied as a polygon or as multiple teeth. Although the illustrated centering element 9 is a stamped part, it could also be produced by laser cutting, sintering, forging, broaching, water jet cutting, or erosion.

In the illustrated embodiment, the centering element 9 is a separate or loose component, but could also be connected to the engagement plate 6 by integral casting or forging, adhesion, soldering, riveting, screwing, or welding. Instead of the illustrated wedge connection to the tool shaft, a connection can also alternatively be effected by means of an inserted flat spring, by means of spring elements integrated into the centering element 9, which is made of elastic material, by means of rapid-mount retaining rings or the like, or even by means of a press fit. Pursuant to one variation of the illustrated embodiment, the centering element 9 is embodied as a wavy retaining ring and is axially held in a circumferential groove of the tool shaft 4.

Figure 4:
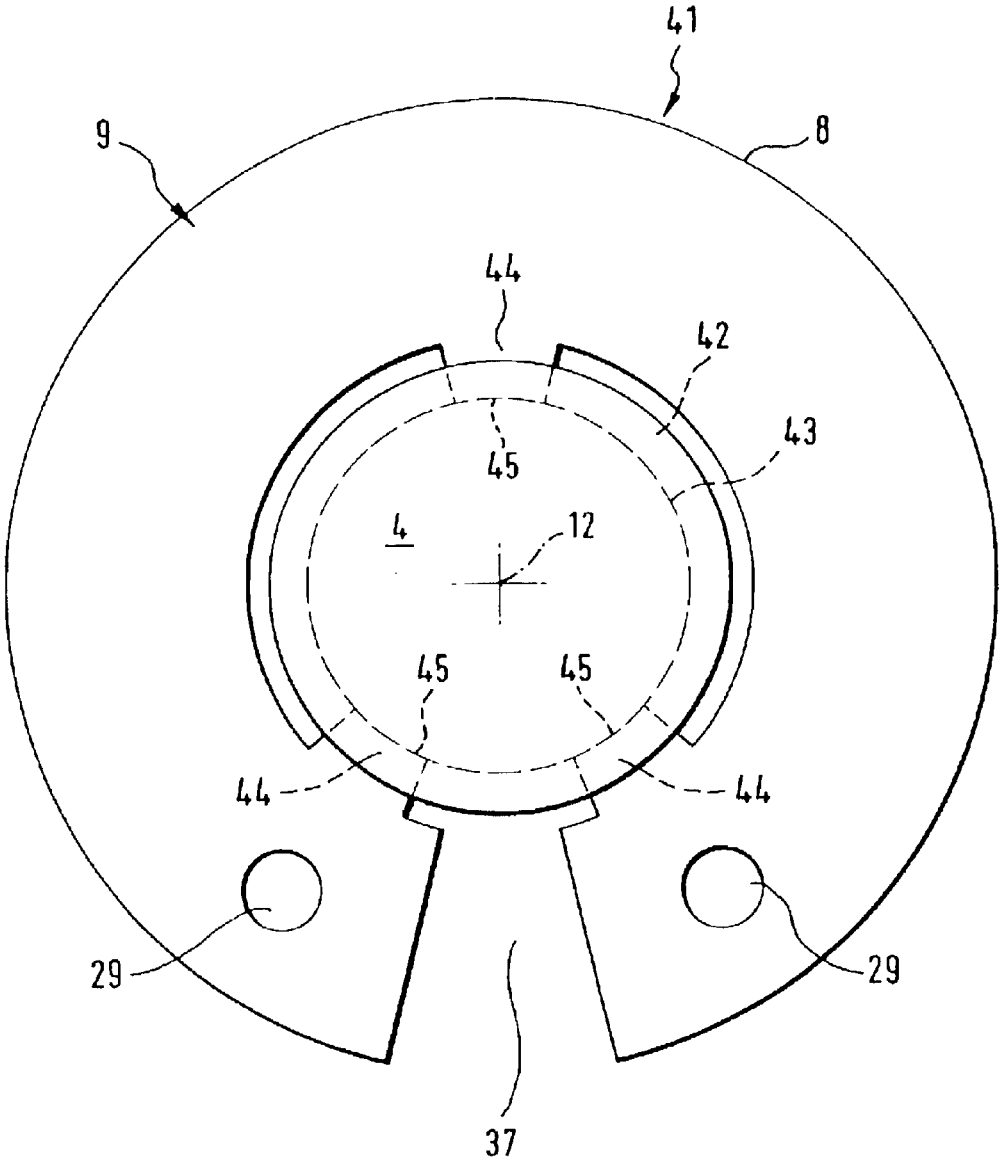
FIG. 4 shows a modification of the centering element of FIG. 3 as a wavy retaining ring.

FIG. 4 illustrates a variation of the centering element 9 that is embodied as a wavy retaining ring 41. For this purpose, the tool shaft 4 which is illustrated in cross-section, is provided with a circumferential groove 42 into which extend three tongues 44 of the retaining ring 41 that project radially inwardly. The centering shoulder 8 of the centering element 9 is centered relative to the shaft axis 12 of the tool shaft 4 in that the radially inner peripheral surfaces 45 of the tongues 44 rest against the base 43 of the groove 42. The retaining ring 41 is made of an elastically resilient steel, has a slot 37, and on both sides thereof a respective tool hole 29. By means of a suitable tool that can be inserted into the tool holes 29, the slot 47 can be spread apart to such an extent that the retaining ring 41 can be assembled or removed.

Figure 5:
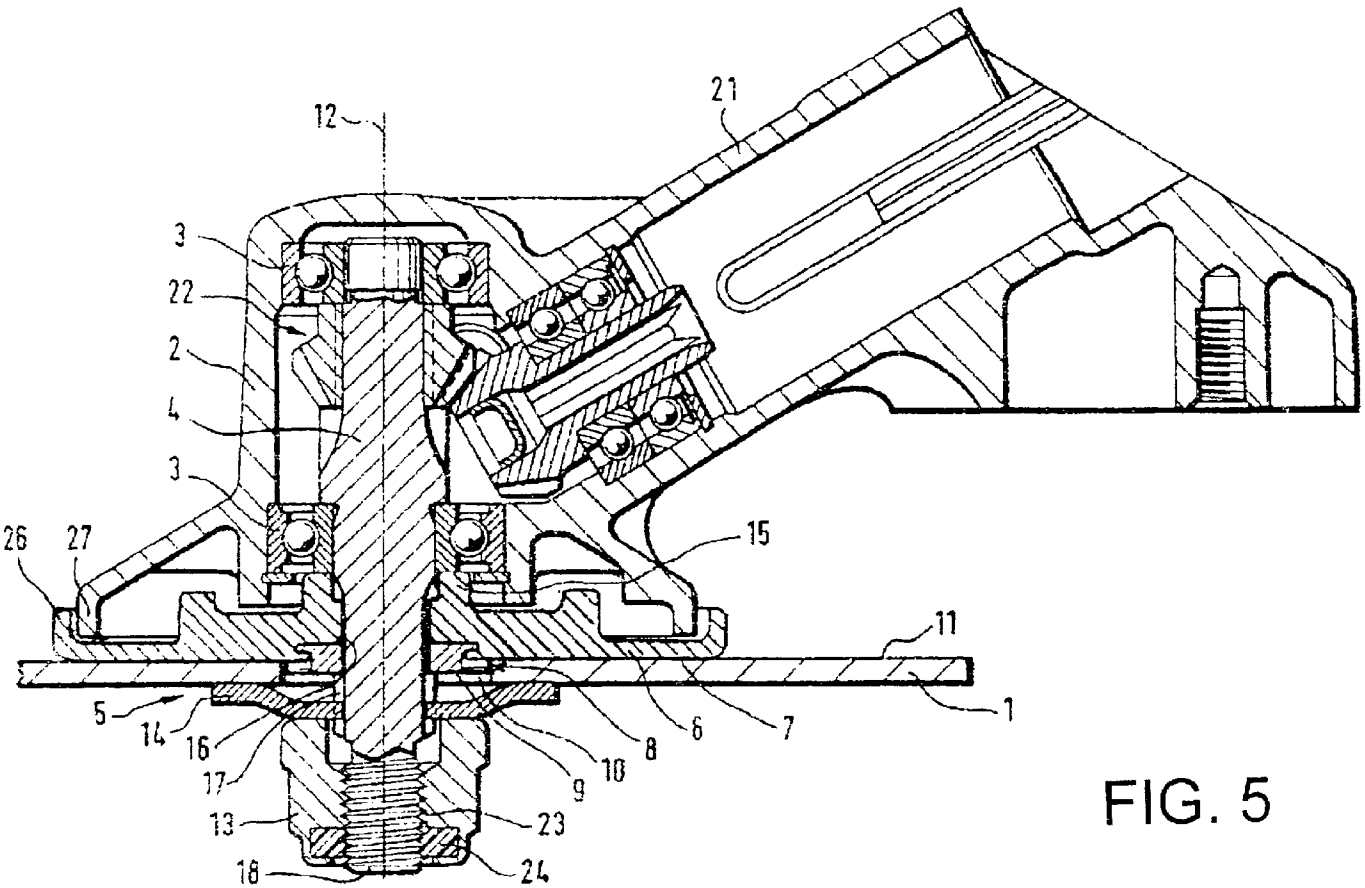
FIG. 5 is a cross-sectional view of another exemplary embodiment of an inventive tool head.
Figure 7:
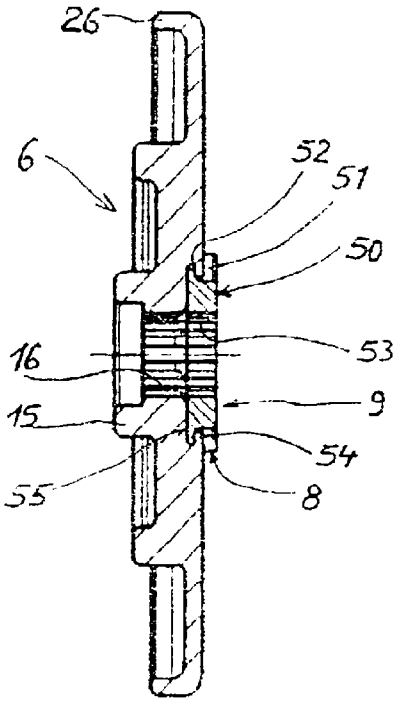
FIG. 7 shows the disk body of FIG. 6 placed upon the tool shaft, which is illustrated in cross-section.
Figure 6:
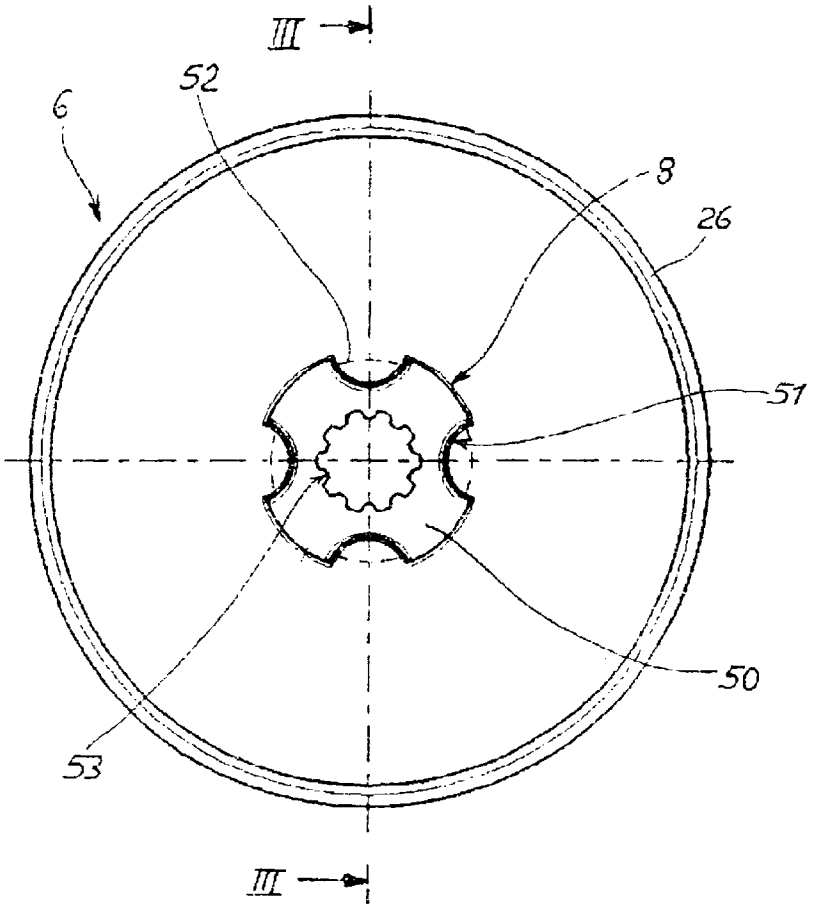
FIG. 6 shows a detailed view of another embodiment of the engagement plate with the centering shoulder formed on a disk body.

FIGS. 5 through 7 show a further embodiment of the present invention. As shown particularly in FIG. 7, a separate component is provided, specifically a disk or ring 50, which serves as the centering element 9. As best shown in FIG. 6, the centering shoulder 8 is formed on the disk 50 and is not formed about the entire circumference of the disk 50. Rather, four recesses 51 are provided (although fewer or more than four recesses can also be used), the recesses being disposed on a side adjacent to the contact surface 7. The recesses preferably have the same angular spacing or distance, as shown in FIG. 6.

In a region of at least one of the recesses 51, the disk 50 is provided with a flange 52 on a side of the disk that lies in a recess 55 of the engagement plate. After insertion of the disk 50 into the recess 55 in the engagement plate 5, material of the engagement plate 6 in an area of the recess 51 is displaced to the rotational axis, and therewith, moved into the recess 51, so that the flange 52, through radially, inwardly caulked material 54 is attached movement-free in the engagement plate 6. The disk 50, likewise, is provided with a central opening like the engagement plate 6, whereby the opening in the disk 50 has inner teeth 53, which exactly correspond to the inner teeth 16 in the hub 15 of the engagement plate. Of course, upon assembling the engagement plate 6 with the disk 50, both sets of inner teeth 16 and 53 are aligned.

In the embodiment of FIGS. 5–7, preferably the disk 50 on which the centering shoulder 8 is formed is made of hardened steel having a hardness range between 45 and 65 HRC. It is also contemplated that the engagement plate can comprise an unhardened steel material and the centering element, i.e., the disk 50, comprises a hardened steel having the hardness range between 45 and 65 HRC.

The specification incorporates by reference the disclosure of German priority document 299 16 643.0 of 22, Sep. 1999.

The present invention is, of course, in no way restricted to the specific disclosure of the specification and drawings, but also encompasses any modifications within the scope of the appended claims.

What we claim is:

1. A tool head for a motor-driven, manually guided implement for receiving a rotatable cutter tool, comprising:

a housing;

a tool shaft that is rotatably mounted in said housing via bearing means; and a tool carrying mechanism that includes an engagement plate and a separate component as a centering element;

wherein said engagement plate is positively connected with said tool shaft, wherein said engagement plate has a contact surface for said cutter tool, said contact surface being oriented at least substantially perpendicular to an axis of said tool shaft, wherein said engagement plate is adapted to be positively connected with said cutter tool by friction between a side of said cutter tool and said contact surface of said engagement plate, wherein said engagement plate is made of light metal selected from the group consisting of aluminum, magnesium, zinc and titanium;

wherein said separate centering element forms a centering shoulder for said cutter tool, wherein said centering shoulder has a circular outer contour and is adapted to be placed in a manner free of play into a circular opening of said cutter tool, and wherein said centering element is made of a hardened material.

2. A tool head according to claim 1, wherein the centering shoulder comprises a material having a range of hardness between 45 and 65 HRC.

3. A tool head according to claim 1, wherein the centering shoulder is formed on a disk, wherein said disk is provided with internal teeth corresponding to internal teeth of said engagement plate.

4. A tool head according to claim 3, wherein said disk has a at least one recess on a side adjacent to said contact surface, and wherein in a region of the at least one recess, the disk is provided with a flange on a side of the disk that lies in a recess of the engagement plate.

5. A tool head according to claim 4, wherein said disk is provided with three recesses, wherein the three recesses have the same angular spacing.

6. A tool head according to claim 4, wherein said disk is provided with four recesses.

7. A tool head according to claim 3, wherein said disk is attached to said engagement plate by means of caulking with a material radially inward.

8. A tool head according to claim 1, wherein said engagement plate is embodied as a forged aluminum part.

9. A tool head according to claim 1, wherein the engagement plate comprises die cast aluminum.

10. A tool head according to claim 1, wherein said centering element and said cutter tool are made of steel.

11. A tool heading according to claim 1, which includes a nut threaded onto said tool shaft, and a cup spring that is disposed between said nut and said cutter tool, wherein said cutter tool is adapted to be pressed against said contact surface of said engagement plate by means of said nut and said cup spring.

12. A tool head for a motor-driven, manually guided implement for receiving a rotatable cutter tool, comprising:

a housing;

a tool shaft that is rotatably mounted in said housing via bearing mean; and a tool carrying mechanism that includes an engagement plate and a separate component as a centering element;

wherein said engagement plate is positively connected with said tool shaft, wherein said engagement plate has a contact surface for said cutter tool, said contact surface being oriented at least substantially perpendicular to an axis of said tool shaft, wherein said engagement plate is adapted to be positively connected with said cutter tool by friction between a side of said cutter tool and said contact surface of said engagement plate, wherein said engagement plate is made of light metal selected from the group consisting of aluminum, magnesium, zinc and titanium;

wherein said separate centering element forms a centering shoulder for said cutter tool, wherein said centering shoulder has a circular outer contour and is adapted to be pieced in a manner free of play into a circular opening of said cutter tool, wherein said centering element is made of a hardened material, and wherein said engagement plate, in a region of a hut thereof, is provided with internal teeth that engage in external teeth of said tool shaft.

* * * * *